US010201817B2

(12) United States Patent
Peltokoski

(10) Patent No.: US 10,201,817 B2
(45) Date of Patent: Feb. 12, 2019

(54) METHOD FOR CONTROLLING DISCHARGE TIMING OF CENTRIFUGAL SEPARATOR AND CENTRIFUGAL SEPARATOR BASED ON PRESSURE MEASUREMENT

(71) Applicant: WARTSILA FINLAND OY, Vaasa (FI)

(72) Inventor: Raine Peltokoski, Vaasa (FI)

(73) Assignee: WARTSILA FINLAND OY, Vaasa (FI)

( * ) Notice: Subject to any disclaimer, the term of this patent is extended or adjusted under 35 U.S.C. 154(b) by 144 days.

(21) Appl. No.: 15/123,853

(22) PCT Filed: Mar. 13, 2015

(86) PCT No.: PCT/FI2015/050163
§ 371 (c)(1),
(2) Date: Sep. 6, 2016

(87) PCT Pub. No.: WO2015/150621
PCT Pub. Date: Oct. 8, 2015

(65) Prior Publication Data

US 2017/0014835 A1 Jan. 19, 2017

(30) Foreign Application Priority Data

Mar. 31, 2014 (FI) ..... 20145301

(51) Int. Cl.
*B04B 1/14* (2006.01)
*B04B 11/04* (2006.01)
*B04B 13/00* (2006.01)

(52) U.S. Cl.
CPC ..... *B04B 1/14* (2013.01); *B04B 11/04* (2013.01); *B04B 13/00* (2013.01)

(58) Field of Classification Search
CPC .. B04B 1/14; B04B 11/04; B04B 7/14; B04B 1/10; B04B 1/12; B04B 1/16; B04B 1/18; B04B 13/00
See application file for complete search history.

(56) References Cited

U.S. PATENT DOCUMENTS 3,580,493 A 5/1971 Jonsson
5,800,330 A * 9/1998 Modeer ..... B04B 1/14 494/10

(Continued)

FOREIGN PATENT DOCUMENTS

EP 2644278 A1 10/2013
WO WO 2009/010630 A1 1/2009

(Continued)

*Primary Examiner* — Charles Cooley
(74) *Attorney, Agent, or Firm* — Muncy, Geissler, Olds & Lowe, P.C.

(57) ABSTRACT

The method controls timing of a discharge event of a centrifugal separator, during which discharge event at least part of a heavier liquid and/or sludge or solids separated from a lighter liquid is discharged from the separator through at least one discharge opening. The discharge opening is opened and/or closed hydraulically. The method comprises the steps of waiting for a scheduled discharge time, measuring the pressure of the liquid used for opening and/or closing the discharge opening, comparing the measured pressure to a predetermined limit value, and, in the case the pressure is below the limit value, delaying the discharge event.

10 Claims, 3 Drawing Sheets

(56) References Cited

U.S. PATENT DOCUMENTS

| | | | | |
|---|---|---|---|---|
| 6,358,193 | B1 * | 3/2002 | Nyberg | B03D 1/1418 494/10 |
| 7,678,039 | B2 * | 3/2010 | Gunnar | B04B 1/14 494/10 |
| 10,022,729 | B2 * | 7/2018 | Hartmann | B04B 1/14 |
| 2009/0137377 | A1 * | 5/2009 | Astrom | B04B 1/14 494/37 |
| 2015/0045199 | A1 * | 2/2015 | Thorwid | B04B 1/08 494/2 |
| 2017/0014835 | A1 * | 1/2017 | Peltokoski | B04B 1/14 |
| 2018/0117601 | A1 * | 5/2018 | Borgstrom | B04B 1/08 |

FOREIGN PATENT DOCUMENTS

| | | | | |
|---|---|---|---|---|
| WO | WO 2009/010631 | A1 | 1/2009 | |
| WO | WO-2012029167 | A1 * | 3/2012 | B04B 1/08 |

* cited by examiner

METHOD FOR CONTROLLING DISCHARGE TIMING OF CENTRIFUGAL SEPARATOR AND CENTRIFUGAL SEPARATOR BASED ON PRESSURE MEASUREMENT

TECHNICAL FIELD OF THE INVENTION

The present invention relates to a method for controlling timing of a discharge event of a centrifugal separator. The invention also concerns a centrifugal separator.

BACKGROUND OF THE INVENTION

Two liquids with different densities can be separated from each other by means of a centrifugal separator. Alternatively or additionally, a centrifugal separator can be used for separating sludge and/or other solids from a liquid. For example, centrifugal separators in connection with piston engines in marine or power plant use are used for separating sludge and water from lubrication oil and fuel. A centrifugal separator typically comprises a rotatable bowl, i.e. a rotor, having a stack of disks. A sludge volume for the heavier liquid and the sludge or solids is formed inside the bowl adjacent to the perimeter of the bowl. As the bowl rotates, the solids and/or the heavier liquid, i.e. the liquid having a higher density, are transferred by centrifugal force into the sludge volume of the bowl, from which they can be removed. The separated liquid, having a lower density, is transferred through the disk stack to the inner part of the bowl, wherefrom it is discharged from the separator.

The heavier material is discharged from the bowl via discharge openings at certain intervals. The discharge openings are usually opened and closed hydraulically. In a typical centrifugal separator, the bowl comprises a lower half and an upper half. The lower half is pressed against the upper half by hydraulic pressure in a closure chamber. By introducing control liquid into a control chamber, the hydraulic pressure can be discharged from the closure chamber. The lower half is thus displaced and the discharge openings are revealed. At the end of a discharge event, closure liquid is introduced into the closure chamber and the lower half moves upwards covering the discharge openings and ending the discharge event. The closure liquid and the control liquid are typically fresh water. At power plants, the separators are usually connected to the same fresh water system as many other consumers of fresh water, such as a steam system and equipment for turbocharger washing. If equipment connected to the fresh water system is using a lot of water, the separators may suffer from lack of water or of reduced water pressure. If a scheduled discharge event takes place at such a point of time, the discharge openings may not open or do not close properly.

SUMMARY OF THE INVENTION

An object of the present invention is to provide an improved method for controlling the timing of a discharge event of a centrifugal separator. During the discharge event at least part of a heavier liquid and/or sludge or solids separated from a lighter liquid is discharged from the separator through at least one discharge opening. The discharge opening is opened and/or closed hydraulically.

The control method comprises the steps of waiting for a scheduled discharge time, measuring the pressure of the liquid that is used for opening and/or closing the discharge opening at the scheduled discharge time or before the scheduled discharge time, comparing the measured pressure to a predetermined limit value, and, in the case the pressure is below the limit value, delaying the discharge event.

By delaying the discharge event in the case of an insufficient pressure of the liquid that is used for opening and closing the discharge opening, the proper functioning of the discharging of the heavier material from the separator can be ensured.

The centrifugal separator, which is arranged to separate a heavier liquid and/or sludge or solids from a lighter liquid and to remove at least part of the heavier liquid and/or sludge or solids from the separator during a discharge event, comprises a control unit which is configured to implement the method defined above.

BRIEF DESCRIPTION OF THE DRAWINGS

Embodiments of the invention are described below in more detail with reference to the accompanying drawings, in which.

DESCRIPTION OF EMBODIMENTS OF THE INVENTION

Figure 1:
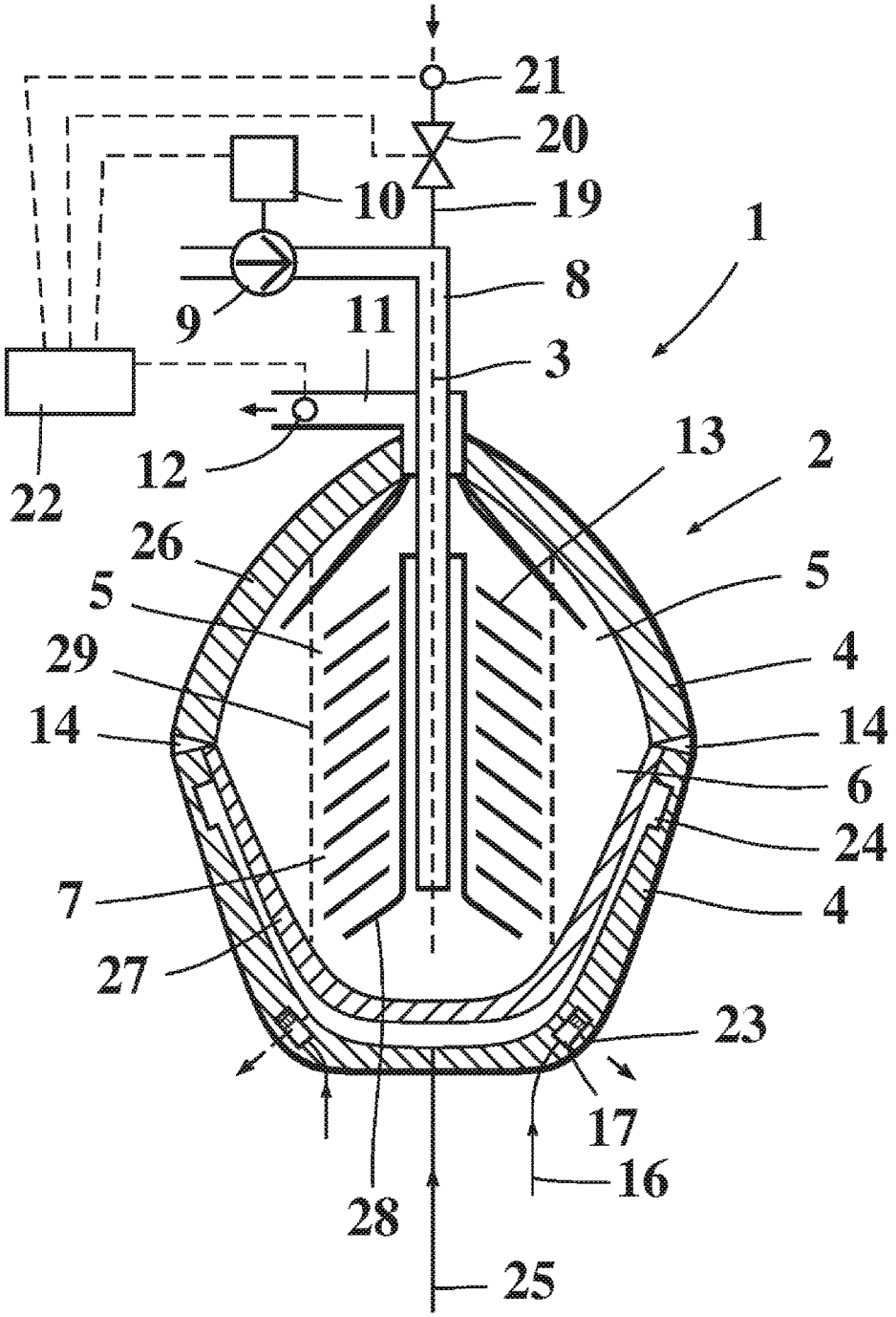
FIG. 1 shows an example of a centrifugal separator as a cross-sectional view.

FIG. 1 shows an example of a centrifugal separator 1 used for separating two liquids having different densities from each other and/or separating sludge and other solids from a liquid. There are two main types of centrifugal separators 1. One is a clarifier separator, used for separating solids and sludge from a liquid. The other is a purifier separator used for separating a heavier liquid and solids/sludge from a lighter liquid. In power plant engines the centrifugal separators 1 are used for separating water and/or sludge and other solids from fuel or lubrication oil. The centrifugal separator 1 can be either of the above-mentioned types.

The separator 1 comprises a rotor i.e. a bowl 2 rotatable about an axis of rotation 3. The bowl 2 comprises a body 4 delimiting a separation chamber 5, inside which there is a disk stack 13. The body 4 comprises two halves arranged against each other, a lower half 27 and an upper half 26. The lower half 27 is pressed against the upper half 26 by means of a force caused by the pressure of a closure liquid introduced into a closure chamber 24 via a closure liquid line 25. The disk stack 13 and the separation chamber 5 envelope the axis of rotation 3, whereby sludge and other solids and/or liquids having higher density are transferred by centrifugal force during the rotation of the bowl 2 into the outermost volume of the bowl 2, the so-called sludge volume 6. Correspondingly the liquid having smaller density is transferred into the innermost part 7 of the bowl 2. The bowl 2 is enveloped by a stationary housing (not shown).

The separator 1 has an inlet duct, i.e. a stationary inlet tube 8 for introducing the liquid to be separated into the bowl 2. The inlet tube 8 has a pump 9 by means of which liquid is pumped into the bowl 2. The rotation speed of the pump 9 is regulated by means of a frequency converter 10. The bowl 2 comprises a disk stack 13 between the disks of which the heavier liquid and/or sludge or other solids are separated from the lighter liquid. The inlet tube 8 is located in the middle part of the bowl 2 parallel with the axis of rotation 3 and its inlet opening is on the axis of rotation 3, whereby the liquid to be separated is introduced to the lower part of the bowl 2, below a distributor 28 located under the disk stack 13. The separator 1 also has an outlet duct, i.e. a stationary discharge tube 11, for discharging the separated, i.e. lighter liquid i.e. liquid having a lower density from the bowl 2. The opening of the discharge tube 11 is located in the inner part 7 of the bowl. The discharge tube 11 is provided with a pressure sensor 12 for measuring the pressure of the separated, i.e. lighter, liquid discharged from the separator 1.

The outer circumference of the bowl 2 comprises openable and closable discharge openings 14 through which sludge and other solids are removed from the bowl during a discharge event. The discharge openings 14 are opened by sliding the lower half 27 downwards. The movement of the lower half 27 is provided by means of a control liquid introduced into a control chamber 17 via a control liquid line 16. The control chamber 17 comprises a discharge mechanism that allows the pressure in the closure chamber 24 to be discharged via the nozzles 23 of the control chamber 17 by the influence of the pressure of the control liquid. Thus, the pressure in the bowl 2 causes the lower half 27 to slide downwards and the discharge openings 14 open. The bowl 2 is closed by ending the introduction of control liquid into the control chamber 17 and by adding closure liquid into the closure chamber 24. The pressure of the closure liquid will again start to have an effect in the closure chamber 24 and the lower half 27 slides back against the upper half 26 and covers the discharge openings 14.

The separator 1 is provided with a displacement liquid inlet tube 19 connected to the inlet tube 8 for introducing displacement liquid into the bowl 2 via the inlet tube 8. Introduction of displacement liquid fills the bowl 2 with a heavier liquid and thus prevents discharging of the lighter liquid from the bowl 2 via discharge openings 14 during the discharge event. The inlet tube 19 of displacement liquid is provided with a closure valve 20, such as an electric solenoid valve by means of which the flow of displacement liquid into the bowl 2 can be allowed or prevented.

The bowl 2 is rotated about the axis of rotation 3 during the operation of the centrifugal separator 1. The liquid to be separated is pumped with a pump 9 via the inlet tube 8 into the bowl 2. The flow of the liquid introduced into the bowl 2 is adjusted to be suitable by changing the rotation speed of the pump 9 by means of the frequency converter 10. The separator 1 comprises an electric control unit 22, which changes the output frequency of the frequency converter 10, i.e. in practice the rotation speed of the pump 9 on the basis of the need at the target application of the separated liquid. In the bowl 2 the heavier liquid, i.e. the liquid with a higher density, and/or sludge and other solids are transferred to the outer part of the bowl 2, i.e. the sludge volume 6. The lighter liquid, i.e. the liquid with a lower density, is transferred through the disk stack 13 into the inner part 7. In a purifier type separator the heavier liquid is continuously discharged from the outer part 6 via a so-called gravity disc (not shown).

Separated, i.e. the lighter liquid is removed from the bowl 2 via the discharge tube 11. Heavier liquid and/or sludge and solids are discharged from the sludge volume 6 of the bowl 2 periodically via discharge openings 14. At the beginning of the discharge event the introduction of the liquids to be separated into the bowl 2 via the inlet tube 8 is stopped. Subsequent to this, the closure valve 20 is opened and the introduction of displacement liquid to the bowl 2 is started. The density of the displacement liquid is higher than that of the separated liquid. Usually the displacement liquid is the same as the heavier liquid in the sludge volume 6 of the bowl, typically water. Due to the introduction of the displacement liquid the amount of the heavier liquid in the bowl 2 is increased, whereby the interface 29 between the lighter and the heavier liquid moves towards the inner part 7 of the bowl.

If too small amount of displacement liquid is introduced into the bowl 2 during the introduction event, separated liquid is discharged from the bowl 2 via the discharge openings 14 during the discharge event. On the other hand, if the amount of introduced displacement liquid is too high, displacement liquid is mixed with the separated liquid. At the beginning of the discharge event or before the beginning of the discharge event the introduction of the displacement liquid is stopped by closing the closure valve 20. Control liquid is introduced into the control chamber 17 via the control liquid line 16. Due to the hydraulic pressure in the control chamber 17 the lower half 27 of the bowl 2 is displaced from its place, revealing the discharge openings 14. The heavier liquid and sludge are discharged from the bowl 2 via discharge openings 14 to the housing enveloping the bowl 2. The aim is to provide as small as possible loss of the lighter, separated liquid, usually oil, during the discharge of the bowl 2. As the discharge event ends, the introduction of the control liquid is stopped and the hydraulic pressure in the control chamber 17 is discharged via nozzles 23. Subsequent to this, closure liquid is introduced below the lower half 26 of the bowl 2 into the closure chamber 24, whereby the lower half 27 moves upwards and again covers the discharge openings 14 and the discharge event ends.

The inlet tube 19 of the displacement liquid is provided with a pressure sensor 21 for measuring the pressure of the displacement liquid. The sensor 21 is located before the closure valve 20 in the flow direction of the displacement liquid in the displacement liquid inlet tube 19. The electric control unit 22 is arranged to receive data from the pressure sensor 21. The control unit 22 can also receive data from the discharge tube pressure sensor 12 and/or other sensors. The control unit 22 controls the closure valve 20 and the rotation speed of the pump 9.

Figure 2:
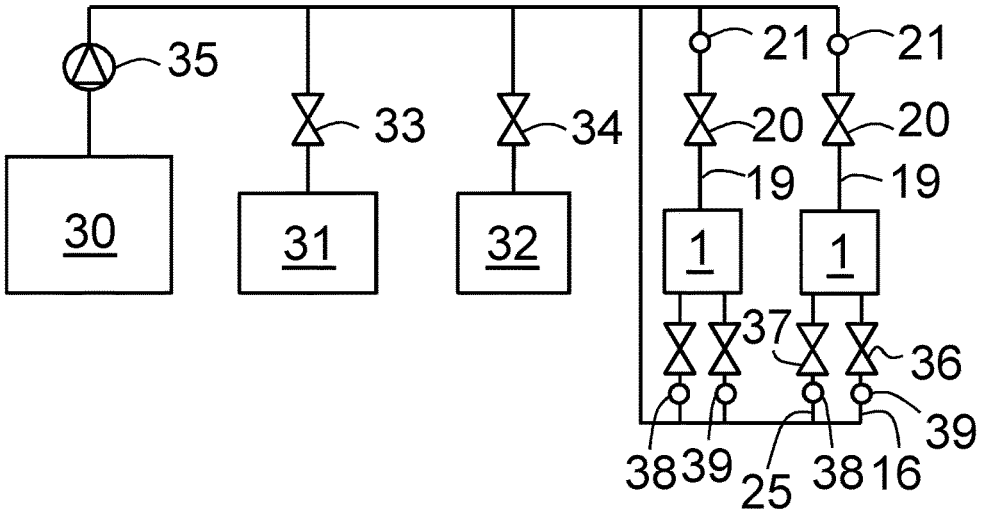
FIG. 2 shows schematically a fresh water system of a power plant.

In FIG. 2 are shown schematically two centrifugal separators 1, which are connected to a fresh water system of a power plant. The fresh water is used as the closure liquid and as the control liquid in the separators 1. The closure liquid lines 25 and the control liquid lines 16 of the separators 1 are therefore connected to the fresh water system. Each of the separators 1 is provided with a closure liquid control valve 37 for controlling the closure liquid supply into the closure chamber 24 and with a control liquid control valve 36 for controlling the control liquid supply into the control chamber 17. The fresh water is also used as the displacement liquid in the separators 1. The fresh water system comprises a water tank 30, from which water is supplied by means of a pump 35 to the equipment using water. In the example of FIG. 2, the system comprises, in addition to the separators 1, a steam system 31 and a turbocharger washing equipment 32. The system is also provided with valves 33, 34 for controlling the flow of water to the steam system 31 and the washing equipment 32. Instead or in addition to the steam system 31 and the washing equipment 32, the water system could comprise many other water-consuming devices and/or processes. When one or several parts of the water system is temporarily using large amounts of water, a separator 1 may suffer from a lack of water or of insufficient water pressure for the purpose of being used as the closure liquid and the control liquid.

If the pressure of the control liquid is too low, the pressure in the closure chamber 24 is not discharged and the discharge openings 14 do not open. If the pressure of the closure liquid is too low, the discharge openings 14 are not closed and the separators 1 leak. To ensure the proper functioning of the discharging of the heavier liquid and/or any sludge or solids, the discharge event is controlled in the way described below.

The discharging of the heavier material from the separator 1 takes in principle place according to a predetermined schedule. Thus, the discharge events take place at certain intervals. Each discharge event comprises the steps of terminating the introduction of the liquid to be processed into the separator 1, opening the closure valve 20 for introducing the displacement liquid into the bowl 2, and introducing the control liquid into the control chamber 17 by opening the control valve 36. The control liquid allows the pressure in the closure chamber 24 to be discharged, and the lower half 27 of the bowl 2 thus slides downwards and opens the discharge openings 14. The discharge event is terminated by opening the closure liquid control valve 37 and allowing closure liquid flow into the closure chamber 24. The pressure in the closure chamber 24 moves the lower half 27 of the bowl 2 upwards and closes the discharge openings 14.

To ensure that an insufficient water pressure does not prevent proper discharging of the heavier material, the water pressure is monitored. In the embodiment of the figures, the water pressure is monitored by the pressure sensor 21 that is located in the inlet tube 19 of the displacement liquid. However, the pressure could also be monitored in some other place of the water system. For instance, a pressure sensor 38 could be placed upstream from the closure liquid control valve 37 and/or a pressure sensor 39 could be placed upstream from the control liquid control valve 36. A pressure sensor could also be located on the downstream side of the pump 35. The pressure monitoring can be continuous or can take place when the scheduled discharge event is about to start. The pressure can thus be measured at the predetermined discharge time or shortly before it.

Figure 3:
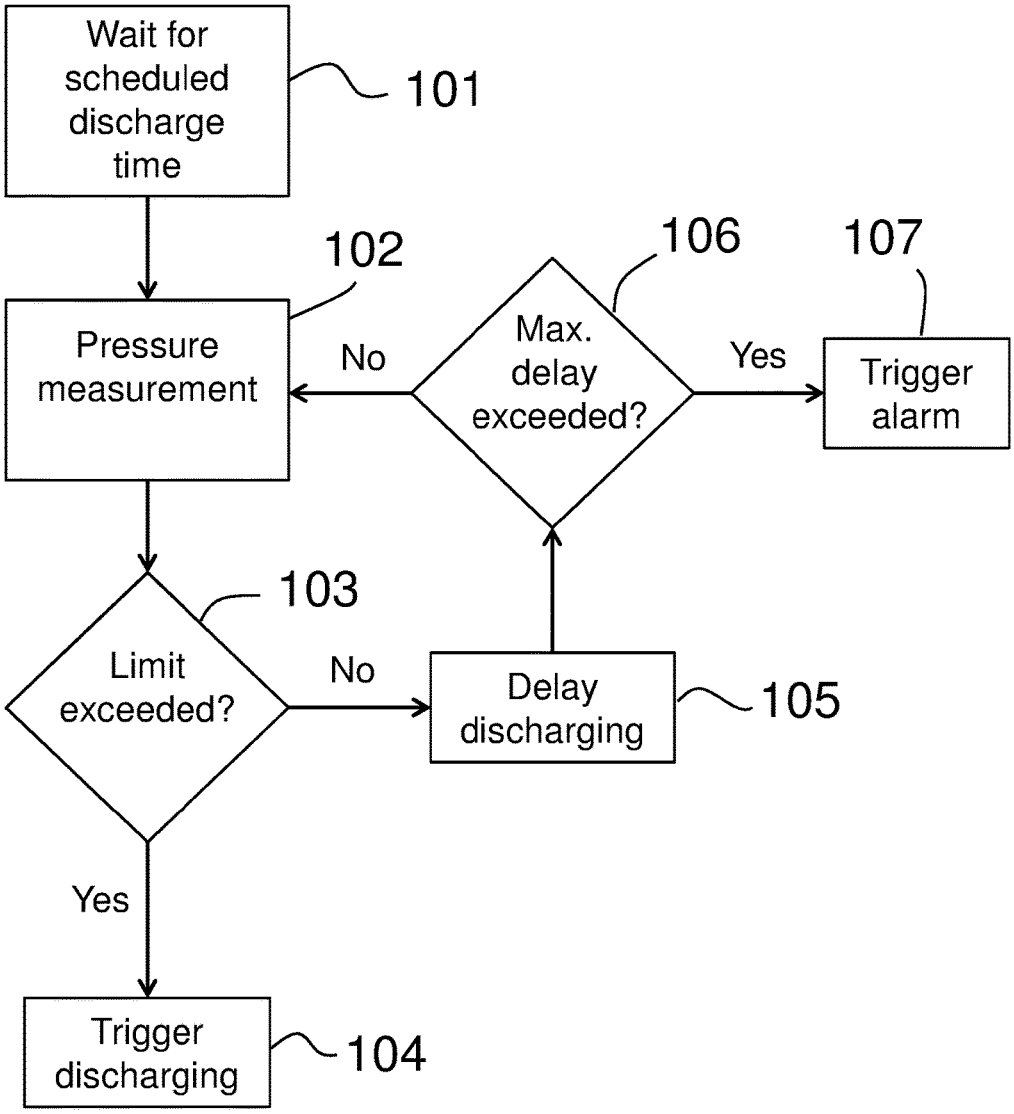
FIG. 3 shows as a flow chart a control method according to the invention.

A scheduled discharge event is waited for in phase 101. The pressure of the water is measured in phase 102 and the pressure sensor 21 sends the measured value to the control unit 22, which compares the measured pressure to a predetermined limit value in phase 103. If the measured pressure is at least equal to the predetermined limit value, the control unit 22 terminates introduction of the liquid to be processed into the bowl 2 by stopping the pump 9 and allows opening of the closure valve 20. The discharge event thus takes place as scheduled in phase 104. However, if the measured pressure is below the limit value, the discharge event is delayed (phase 105). The separation thus continues in the normal way in the separator 1. When a predetermined period of time has lapsed from the first measurement, the pressure measurement is repeated. If the water pressure has meanwhile reached the limit value, the discharge event is initiated (phase 104). However, if the water pressure is still below the limit value, the discharge event is delayed further. This cycle can be continued until the minimum water pressure is reached. The duration of the period of time between the consecutive pressure measurements can be constant, or it can vary according to a predetermined pattern. In the embodiment of FIG. 3, the control method comprises an additional phase 106, in which the duration of the delay is determined. After each pressure measurement, the control unit 22 determines whether a maximum delay for triggering the discharge event has been exceeded. This can be done by counting the number of pressure measurements or by measuring the time that has lapsed from the scheduled discharge time. If the predetermined maximum number of pressure measurements have been taken or a predetermined period of time has lapsed from the scheduled discharge time, an alarm is triggered in phase 107.

Instead of the sampling method of FIG. 3, the pressure monitoring can be continuous. Either the pressure is monitored continuously when the separator 1 is in operation, or a continuous pressure monitoring is started when a scheduled discharge event is about to take place. If the discharge event is delayed, the pressure measurement continues, and the discharge event is initiated when the pressure reaches the predetermined limit value. If the water pressure has not reached the limit value within a predetermined maximum time, an alarm is triggered in the similar way as in the method comprising separate pressure measurements at certain intervals.

In addition for being used to measure the water pressure for determining whether a discharge event can take place, the pressure sensor 21 can be utilized for other purposes. For instance, the amount of the displacement liquid introduced into the bowl 2 can be controlled by using the data received from the pressure sensor 21.

It will be appreciated by a person skilled in the art that the invention is not limited to the embodiments described above, but may vary within the scope of the appended claims. For instance, the liquid used as the closure liquid and control liquid could be some other liquid than water and the method and the separator could be used in some other system than a water system of a power plant. Also the construction of the separator is only an example of a separator, to which the method could be applied. Both the opening and closing of the discharge openings do not need to be hydraulic, but one of the functions could be implemented in another way. For instance, the closure liquid could be released by means of a solenoid valve, in which case only the closing function of the separator would be hydraulic.

The invention claimed is:

1. A method for controlling timing of a discharge event of a centrifugal separator, during which discharge event at least part of a heavier liquid and/or sludge or solids separated from a lighter liquid is discharged from the separator through at least one discharge opening, the discharge opening being hydraulically opened and/or closed, the method comprising the steps of waiting for a scheduled discharge time, at the scheduled discharge time or before the scheduled discharge time, measuring the pressure of a liquid that is used for opening and/or closing the discharge opening, comparing the measured pressure to a predetermined limit value and, in the case the pressure is below the limit value, delaying the discharge event.

2. The method according to claim 1, wherein in the case of a delayed discharge event the method comprises the steps of continuing the pressure measurement after the scheduled discharge time, and initiating the discharge event when the pressure of the liquid that is used for opening and/or closing the discharge opening has reached a predetermined limit value.

3. The method according to claim 1, wherein the pressure is continuously measured.

4. The method according to claim 1, wherein in the case of a delayed discharge event the method comprises the steps of repeating the pressure measurement after a predetermined period of time has lapsed from the previous pressure measurement and comparing the measured pressure to the predetermined limit value, and in the case the pressure is at least equal to the limit value, initiating the discharge event.

5. The method according to claim 4, wherein the steps of repeating the pressure measurement and comparing the measured pressure to the predetermined limit value are repeated at predetermined intervals, if the pressure has not reached the predetermined limit value in the previous measurement.

6. The method according to claim 1, wherein the method comprises the step of monitoring the time that has lapsed from the scheduled discharge time and/or the number of pressure measurements after the scheduled discharge time and in the case the discharge event has not been initiated within a predetermined period of time or within a predetermined number of pressure measurements, triggering an alarm.

7. The method according to claim 1, wherein the pressure is measured in a control liquid line, through which a control liquid is introduced into the separator for opening the discharge openings.

8. The method according to claim 1, wherein the pressure is measured in a closure liquid line, through which a closure liquid is introduced into the separator for closing the discharge openings.

9. The method according to claim 1, wherein the pressure is measured in a displacement liquid line, through which displacement liquid is introduced into the separator for preventing the lighter liquid from being discharged from the separator during a discharge event.

10. A centrifugal separator, which is arranged to separate a heavier liquid and/or sludge or solids from a lighter liquid and to remove at least part of the heavier liquid and/or sludge or solids from the separator during a discharge event, the separator comprising a control unit which is configured to implement the method according to claim 1.

* * * * *